US007383848B2

(12) United States Patent
Kowsky

(10) Patent No.: US 7,383,848 B2
(45) Date of Patent: Jun. 10, 2008

(54) FOREARM WALKING CRUTCH

(75) Inventor: Stefan Kowsky, Neumuenster (DE)

(73) Assignee: Erwin Kowsky GmbH & Co. KG, Neumunster (DE)

( * ) Notice: Subject to any disclaimer, the term of this patent is extended or adjusted under 35 U.S.C. 154(b) by 60 days.

(21) Appl. No.: 11/433,935

(22) Filed: May 15, 2006

(65) Prior Publication Data

US 2006/0260664 A1 Nov. 23, 2006

(30) Foreign Application Priority Data

May 14, 2005 (DE) ..... 10 2005 022 477

(51) Int. Cl.
*A61H 3/02* (2006.01)

(52) U.S. Cl. ..... 135/73; 136/72

(58) Field of Classification Search ..... 135/73, 135/68, 71, 72, 910, 69; 482/67, 75
See application file for complete search history.

(56) References Cited

U.S. PATENT DOCUMENTS 2,516,852 A * 8/1950 Burry et al. ..... 135/71
3,213,869 A * 10/1965 Frank ..... 135/71
5,038,811 A * 8/1991 Gilmore ..... 135/71
5,671,765 A * 9/1997 Hagberg, Jr. ..... 135/68
5,771,910 A * 6/1998 Kluttz ..... 135/68
7,204,262 B2 * 4/2007 DeMay et al. ..... 135/68

FOREIGN PATENT DOCUMENTS

| | | |
|---|---|---|
| DE | 9406020.7 | 4/1994 |
| DE | 10015589 | 11/2000 |
| FR | 2834882 | 7/2003 |

* cited by examiner

*Primary Examiner*—David R Dunn
*Assistant Examiner*—Kaitlin A Wilson
(74) *Attorney, Agent, or Firm*—Diederiks & Whitelaw, PLC

(57) ABSTRACT

A forearm walking crutch includes an upper part mounted on a stick. The upper part carries a forearm sleeve and includes a grip. The sleeve is adapted to embrace the forearm of a user by more than 270° and is pivotably attached to the upper part. The upper part includes an upper piece and a lower piece, with the upper piece being adjustable relative to a lower piece. A device is provided to fix the upper and lower pieces against relative movement. The sleeve is pivotal between a first position which covers the device and a second position which exposes the device.

4 Claims, 2 Drawing Sheets

Fig.2 A-A

FOREARM WALKING CRUTCH

BACKGROUND OF THE INVENTION

The present invention pertains to a forearm walking crutch with a stick and a plastic upper part mounted thereon and constructed from a forearm sleeve and a grip.

Forearm crutches are known, such as represented by DE 94 06020 U. In the case of this known forearm crutch, the problem arises that even on releasing the hand from the grip the user cannot freely use the hand without putting down the crutch.

The invention is concerned with developing a forearm crutch wherein the user can substantially freely use his hand upon releasing from the grip without putting down the crutch.

SUMMARY OF THE INVENTION

According to the invention, this problem is solved in that a forearm crutch includes a sleeve constructed so as to embrace the forearm by more than 270° and is pivotably attached to an upper crutch part. As a result of the proposed construction, on releasing the hand from a grip, the hand can be freely used and the forearm walking crutch remains fixed to the forearm.

A preferred embodiment is characterized in that the upper part comprises a lower piece forming the grip and an upper, sleeve-carrying piece guided in the lower piece, one piece being longitudinally adjustably guided in the other piece. A manually operable device is provided for fixing one piece in the other piece. This construction makes it possible to adjust the spacing between the sleeve and the grip in accordance with the given anatomical circumstances and to selectively fix the same in the desired position.

It is also proposed that the sleeve be provided with a shell extending in the direction of the grip and which covers the sleeve when applied to the upper piece and, when the sleeve is pivoted away from the upper piece, releases the same. This construction makes it possible to conceal the device for fixing one piece in the other piece in such a way that it is not visible and cannot be operated in an undesired manner.

Additional objects, features and advantages of the present invention will become more readily apparent from the following detailed description of a preferred embodiment when taken in conjunction with the drawings wherein like reference numerals refer to corresponding parts in the several views.

BRIEF DESCRIPTION OF THE DRAWINGS

FIG. 2 shows the upper part of the crutch rotated by 90° (sectioned along line A-A in FIG. 1), in which the sleeve bears on the upper part.

DETAILED DESCRIPTION OF THE PREFERRED EMBODIMENT

Figure 1:
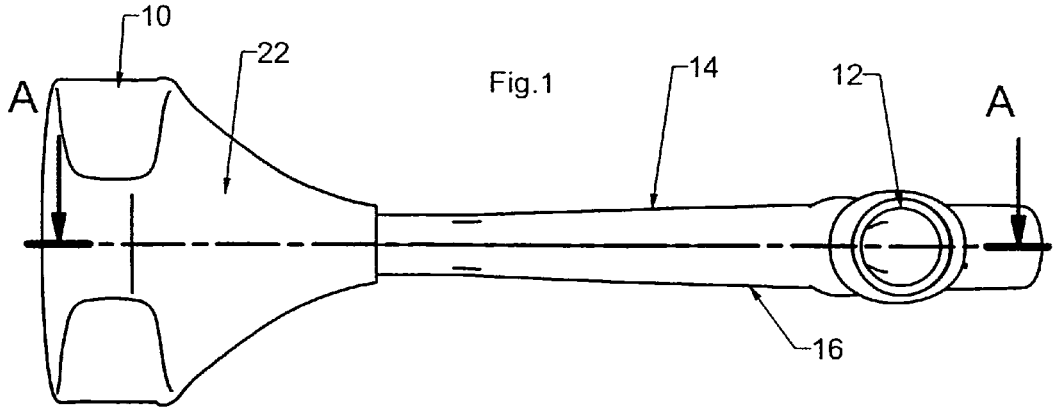
FIG. 1 is a plan view of the upper part of a crutch constructed in accordance with the invention.
Figure 3B:
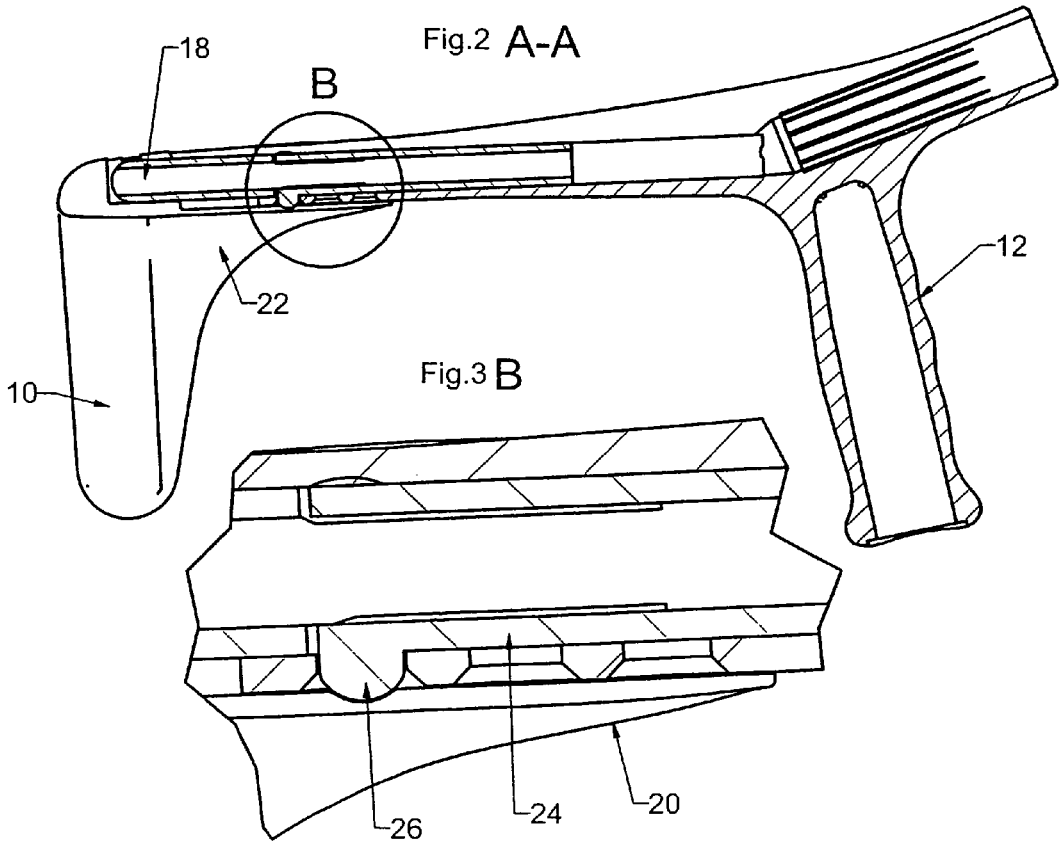
FIG. 3 illustrates detail B in FIG. 2.
Figure 4:
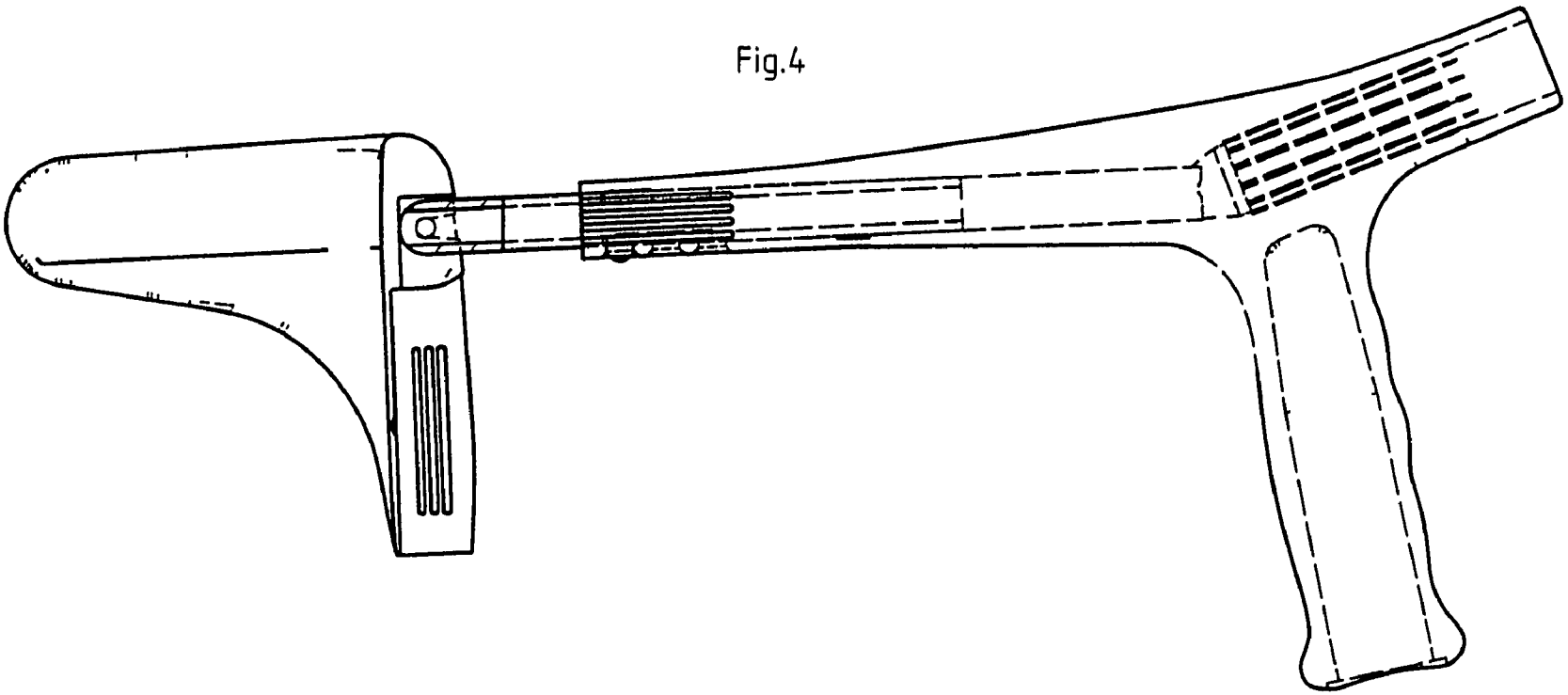
FIG. 4 is representation in which the sleeve is pivoted away from the upper part.

The forearm walking crutch of the present invention comprises a preferably longitudinally adjustable constructed stick (not shown) and a plastic upper part 14 mounted thereon. Upper part 14 includes a forearm sleeve 10 and a grip 12. The sleeve is constructed in such a way that it embraces the forearm by more than 270°. In this manner, when the hand of a user of the crutch is released from grip 12, the crutch is still carried by the forearm of the user. The sleeve is also pivotably attached to the upper part 14 (particularly see FIG. 3).

As a result of this construction, when the user releases his/her hand from grip 12, he/she can still relatively freely use the hand, e.g. for opening a door, while the forearm crutch is still carried by the forearm.

In the embodiment shown, upper part 14 comprises a lower piece 16 forming grip 12 and an upper piece 18 carrying sleeve 10. Upper piece 18 is guided in the lower piece 16 such that piece 18 is longitudinally adjustably guided in lower piece 16. A manually operable device 20 (best shown in FIG. 2) is used for fixing upper piece 18 in lower piece 16. As shown, device 20 is provided with a spring tongue 24, which carries at its free end a hemispherical piece 26. Hemispherical piece 26 is adapted to pass through holes in lower piece 16 and, in this way, fixes together the two pieces 16, 18. The hemispherical piece 26 is manually pressed in for adjustment purposes.

Sleeve 10 is provided with a shell 22 tapering in the direction of grip 12. When sleeve 10 is applied to upper piece 18, shell 22 covers device 20 and, when sleeve 10 is pivoted away from upper piece 18, it releases the same. When sleeve 10 is applied, device 20 is not visible, so that an undesired release of device 20 for fixing upper piece 18 in lower piece 16 is impossible.

Although described with reference to a preferred embodiment of the invention, it should be readily understood that various changes and/or modifications can be made to the invention without departing from the spirit thereof. The lower piece could, alternatively, be equally guided in the upper piece. In general, the invention is only intended to be limited by the scope of the following claims.

I claim:

1. A forearm walking crutch comprising: an upper part adapted to be mounted to a stick, a forearm sleeve and a grip, wherein the sleeve is adapted to embrace the forearm of a user by more than 270° and is pivotably attached to the upper part, wherein the upper part comprises a lower piece forming the grip and an upper piece carrying the forearm sleeve and wherein the upper and lower pieces are relatively, longitudinally adjustable; and a manually operable device for fixing the upper and lower pieces against relative longitudinal movement, wherein the forearm sleeve is provided with a shell extending in a direction of the grip, said shell being adapted to cover the device when the forearm sleeve is pivoted to the upper piece and, when the forearm sleeve is pivoted away from the upper piece, the shell exposes the device.

2. The forearm walking crutch according to claim 1, wherein the forearm sleeve is pivotable relative to each of the upper and lower pieces.

3. The forearm walking crutch according to claim 1, wherein the upper piece is slidably received in the lower piece.

4. The forearm walking crutch according to claim 1, wherein the upper part is made of plastic.

* * * * *